US010917736B2

(12) United States Patent
Tammam

(10) Patent No.: US 10,917,736 B2
(45) Date of Patent: Feb. 9, 2021

(54) SYSTEM AND METHOD FOR SPATIALLY PROJECTED AUDIO COMMUNICATION

(71) Applicant: Anachoic, Ltd., Modiin (IL)

(72) Inventor: Eric S. Tammam, Modiin (IL)

(73) Assignee: Anachoic Ltd., Modiin (IL)

( * ) Notice: Subject to any disclaimer, the term of this patent is extended or adjusted under 35 U.S.C. 154(b) by 0 days.

(21) Appl. No.: 16/559,899

(22) Filed: Sep. 4, 2019

(65) Prior Publication Data

US 2020/0077221 A1 Mar. 5, 2020

Related U.S. Application Data

(60) Provisional application No. 62/726,735, filed on Sep. 4, 2018.

(51) Int. Cl.

| | |
|---|---|
| ***H04S 7/00*** | (2006.01) |
| ***H04R 5/04*** | (2006.01) |
| ***H04R 5/033*** | (2006.01) |
| ***H04R 1/40*** | (2006.01) |

(52) U.S. Cl.

CPC ..... *H04S 7/303* (2013.01); *H04R 1/403* (2013.01); *H04R 5/033* (2013.01); *H04R 5/04* (2013.01); *H04S 2420/01* (2013.01)

(58) Field of Classification Search

CPC ..... H04M 3/568; G06F 3/0484; H04R 3/12; H04R 1/403; H04R 5/033; H04S 7/303; H04S 7/302

USPC ..... 381/303, 77

See application file for complete search history.

(56) References Cited

U.S. PATENT DOCUMENTS

| | | | | |
|---|---|---|---|---|
| 5,914,661 | A | 6/1999 | Gross | |
| 2002/0144418 | A1 | 10/2002 | Endo et al. | |
| 2004/0111271 | A1 | 6/2004 | Tischer | |
| 2004/0226079 | A1 | 11/2004 | Rainey | |
| 2012/0176268 | A1 | 7/2012 | Aker | |
| 2014/0039354 | A1 | 2/2014 | Greenwald et al. | |
| 2015/0052455 | A1* | 2/2015 | Boustead | G06F 3/0484 715/753 |
| 2015/0110286 | A1* | 4/2015 | Norris | G10K 11/346 381/77 |
| 2015/0338659 | A1 | 11/2015 | Gallery | |
| 2016/0209648 | A1 | 7/2016 | Haddick et al. | |

(Continued)

FOREIGN PATENT DOCUMENTS

WO 2014124126 A1 8/2014

OTHER PUBLICATIONS

Article entitled: "A Dual Function Radar-Communications system using sidelobe control and waveform diversity," by Hassanein et al.; IEEE National Radar Conference—Proceedings 2015:1260-1263 2015.

(Continued)

*Primary Examiner* — Paul Kim
*Assistant Examiner* — Ubachukwu A Odunukwe
(74) *Attorney, Agent, or Firm* — Todd Allen Serbin Nexsen Pruet, LLC

(57) ABSTRACT

A system for providing spatially projected audio communication between members of a group, the system mounted onto a respective user of the group, the system comprising: a detection unit; a communication unit; a processing unit; and an audio interface unit, configured to audibly present the synthesized spatially resolved audio signal to the user.

10 Claims, 13 Drawing Sheets

(56) References Cited

U.S. PATENT DOCUMENTS

2019/0392830 A1* 12/2019 Abdollahian ..... G06K 9/00288

OTHER PUBLICATIONS

Article entitled: "Indoor wireless communication using airborne ultrasound and OFDM methods," by Jiang et al; 2016 IEEE International Ultrasonic Symposium 2016.
Young, Lee W.; PCT/US2015/062898; International Search Report and Written Opinion; ISA/US; dated Feb. 12, 2016 dated Feb. 12, 2016.

* cited by examiner

SYSTEM AND METHOD FOR SPATIALLY PROJECTED AUDIO COMMUNICATION

RELATED APPLICATIONS

This application claims the benefit of priority under 35 USC § 119(e) of U.S. Provisional Patent Application No. 62/726,735 filed Sep. 4, 2018, the contents of which is incorporated herein by reference in its entirety.

FIELD OF THE INVENTION

The present invention generally relates to audio communication among multiple users in a group, such as a group of riders.

BACKGROUND OF THE INVENTION

Numerous situations require the use of audio intercommunication for coordination and planning between individuals. Under normal circumstances, this is achieved by simple acoustic transmission and reception through our natural capabilities of speech and hearing. Under certain conditions, this cannot be achieved due to high ambient noise interfering with our hearing and/or involuntary attenuation of our speech from helmets, masks, walls or other acoustic inhibiting media. The attenuation of our voice is sometimes voluntary to avoid other individuals in the area from acquiring information not intended for them or to keep other individuals from being alerted to our presence or to keep from being a nuisance to those around by polluting the ambient acoustic environment with unwanted noise. To address these situations intercommunication systems have been developed that convert sound from a user to an inaudible signal (e.g., ultrasound, electromagnetic, and the like) that is then projected or transmitted to another system that converts the signal back to an audible one and relays it to a second user. This process is bidirectional, allowing for the second user to communicate with the first user, and in some implementations can be done simultaneously. This process can also be applied to numerous users allowing for intercommunication between members of a group. An example of such systems are motorcycle helmet mounted intercommunication systems that allow for groups of riders to communicate while riding at speed.

Existing intercommunication systems generally lack spatial information regarding the relative position of the users in a group. Therefore, all users sound as if they occupy the same point in space and are not perceived to occupy their correct spatial position relative to one another.

SUMMARY OF THE INVENTION

In accordance with one aspect of the present invention, there is thus provided a system for providing spatially projected audio communication between members of a group, the system mounted onto a respective user of the group. The system includes a detection unit, configured to determine the three-dimensional head position of the user, and to obtain a unique identifier of the user. The system further includes a communication unit, configured to transmit the determined user position and the obtained user identifier and audio information to at least one other user of the group, and to receive a user position and user identifier and associated audio information from at least one other user of the group. The system further includes a processing unit, configured to track the user position and user identifier received from at least one other user of the group, to establish the relative position of the other user, and to synthesize a spatially resolved audio signal of the received audio information of the other user based on the updated position of the other user. The system further includes an audio interface unit, configured to audibly present the synthesized spatially resolved audio signal to the user. At least one of the system units may be mounted on the head of the user. The detection unit may include a plurality of sensor modules mounted on a headgear worn by the user in a configuration providing substantially 360° field of coverage. The communication unit may be integrated with the detection unit configured to transmit and receive information via a radar-communication (RadCom) technique.

In accordance with another aspect of the present invention, there is thus provided a method for providing spatially projected audio communication between members of a group, the system mounted onto a respective user of the group. The method includes the procedure of determining the three-dimensional head position of the user, and obtaining a unique identifier of the user, using a detection unit linked to the user. The method further includes the procedures of transmitting the determined user position and the obtained user identifier and audio information to at least one other user of the group, and receiving a user position and user identifier and associated audio information from at least one other user of the group. The method further includes the procedure of tracking the user position and user identifier received from at least one other user of the group, to establish the relative position of the other user, and synthesizing a spatially resolved audio signal of the received audio information of the other user based on the updated position of the other user. The method further includes the procedure of audibly presenting the synthesized spatially resolved audio signal to the user via an audio interface unit.

BRIEF DESCRIPTION OF THE DRAWINGS

The present invention will be understood and appreciated more fully from the following detailed description taken in conjunction with the drawings, which are not necessarily to scale, in which.

DETAILED DESCRIPTION OF THE EMBODIMENTS

The present invention overcomes the disadvantages of the prior art by providing a system and method for spatially projected audio communication between members of a group, such as a group of motorcycle riders. In many situations, spatial information is important in developing a spatial awareness of the surrounding users, and can help avoid unwanted collisions, navigational errors, and misidentification. In the case of communication among a group of motorcycle riders, various scenarios can be improved with spatial audio. For example, individual riders can issue audible directions based on the perceived position of other riders without necessitating eye contact (i.e., without removing the users eyes from the direction of forward movement); riders can coordinate movements based on the perceived position of other riders to avoid potential collisions, and riders can improve their response to hazards that are encountered and communicated among members of the group.

The communication system of the present invention allows for communication between two or more individuals in a group. To allow for spatially projected communications, the system acquires the relative position (localization) of each participant communicating in the group and be able to uniquely identify the participant in the group with an associated identifier (ID). The system transmits the initial position and unique identification of a respective user in a group to other participants in the group. Once the relative position and identification of the user is established, the user's position and identity can be tracked by the systems associated with other members within the group. All audible communications emanating from the user may then be spatially mapped to other members in the group. The systems associated with other members in the group will receive the audio information from the selected user together with the unique ID of the user, establish the relative position of the user, and synthesize a spatially resolved version of the user's audio information based on the receiving user's head position.

Figure 1:
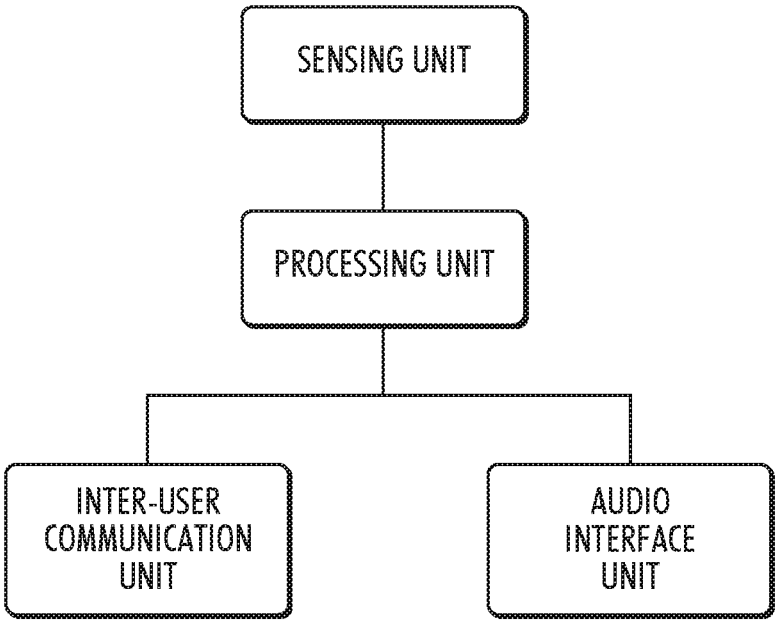
FIG. 1 is a schematic illustration of a high-level topology of a system for spatially projected audio communication between members of a group, constructed and operative in accordance with an embodiment of the present invention.

Reference is made to FIG. 1, which is a schematic illustration of a high-level topology of a system for spatially projected audio communication between members of a group, constructed and operative in accordance with an embodiment of the present invention. The system includes at least some of the following subsystems: a detection (sensing) unit, a positioning unit, a head orientation measurement unit, a communication unit (optional), a processing unit, a power unit and an audio unit.

Figure 2:
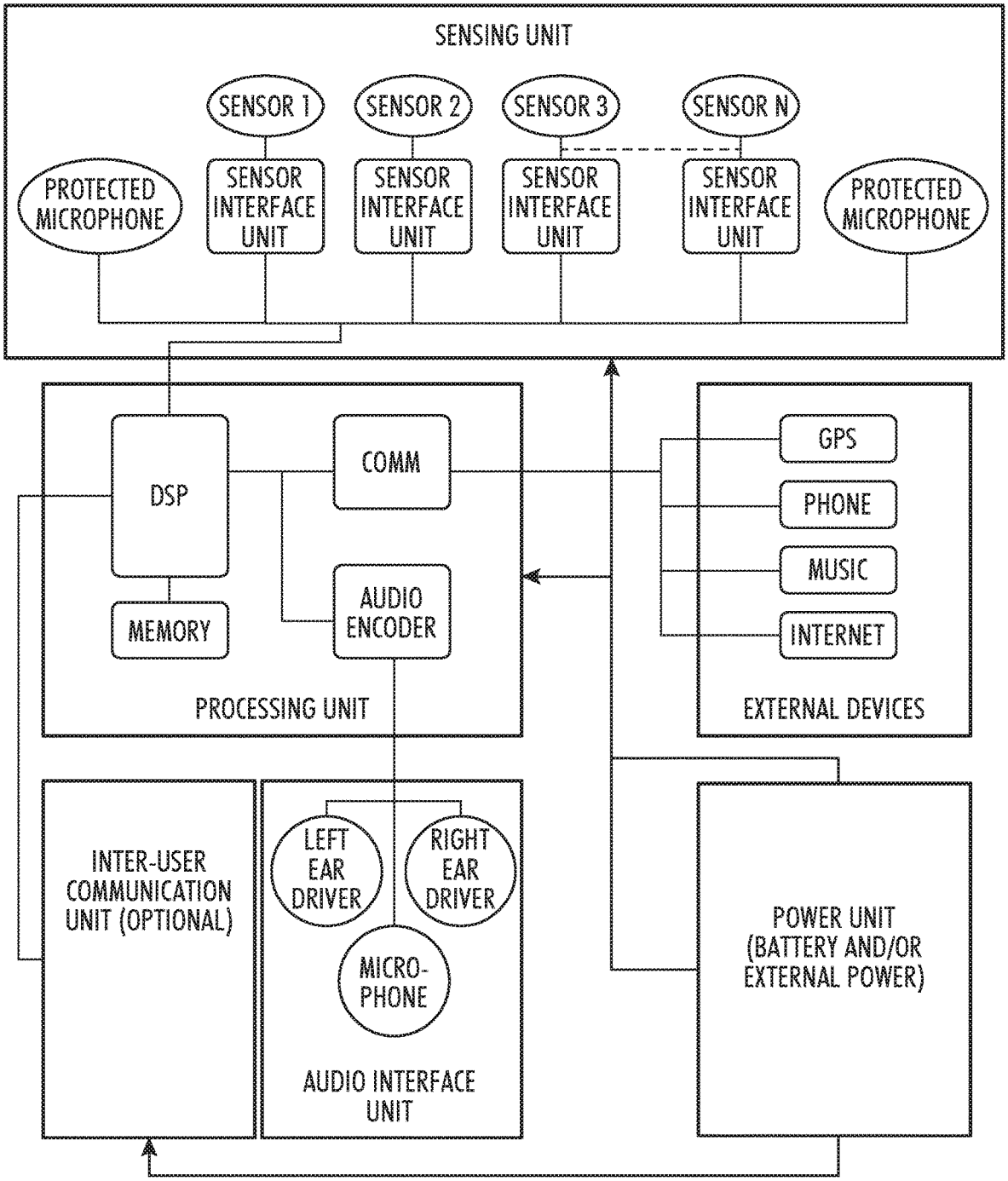
FIG. 2 is a schematic illustration of the subsystems of a system for spatially projected audio communication between members of a group, constructed and operative in accordance with an embodiment of the present invention.

Reference is made to FIG. 2, which is a schematic illustration of the subsystems of a system for spatially projected audio communication between members of a group, constructed and operative in accordance with an embodiment of the present invention. The detection unit may include one or Simultaneous Localization and Mapping (SLAM) sensors, such as at least one of: a radar sensor, a LIDAR sensor, an ultrasound sensor, a camera, a field camera, and a time of flight camera. The sensors may be arranged in a configuration so as to provide 360° (360 degree) coverage around the user and capable of tracking individuals in different environments. In one embodiment, the sensor module is a radar module. A system on chip millimeter wave radar transceiver (such as the Texas Instruments IWR1243 or the NXP TEF8101 chips) can provide the necessary detection functionality while allowing for a compact and low power design, which may be an advantage in mobile applications. The transceiver chip is integrated on an electronics board with a patch antenna design. The sensor module may provide reliable detection of persons for distances of up to 30 m, motorcycles of up to 50 m, and automobiles of up to 80 m, with a range resolution of up to 40 cm. The sensor module may provide up to a 120° azimuthal field of view (FoV) with a resolution of 15°. Three modules can provide a full 360° azimuthal FoV, though in some applications it may be possible to use two modules or even a single module. The radar module in its basic mode of operation can detect objects in the proximity of the sensor but has limited identification capabilities. Lidar sensors and ultrasound sensors may suffer from the same limitations. Optical cameras and their variants can provide identification capabilities, but such identification may require considerable computational resources, may not be entirely reliable and may not readily provide distance information. Spatially projected communication requires the determination of the spatial position of the communicating parties, to allow for accurately and uniquely representing their audio information to a user in three-dimensional (3D) space. Some types of sensors, such as radar and ultrasound, can provide the instantaneous relative velocity of the detected objects in the vicinity of the user. The relative velocity information of the detected objects can be used to provide a Doppler effect on the audio representation of those detected objects.

A positioning unit is used to determine the position of the users. Such positioning unit may include localization sensors or systems, such as a global navigation satellite system (GNSS), a global positioning system (GPS), GLONASS, and the like, for outdoor applications. Alternatively, an indoor positioning sensor that is used as part of an indoor localization system may be used for indoor applications.

The position of each user is acquired by the respective positioning unit of the user, and the acquired position and the unique user ID is transmitted by the respective communication unit of the user to the group. The other members of the group reciprocate with the same process. Each member of the group now has the location information and the accompanied unique ID of each user. To track the other members of the group in dynamic situations, where the relative positions can change, the user systems can continuously transmit, over the respective communication units, their acquired position to other members of the group and/or the detection units can track the position of other members independent of the transmission of the other members positions. Using the detection unit for tracking may provide lower latency (receiving the other members positions through the communications channel is no longer necessary) and the relative velocity of the other members positions relative to the user. Lower latency translates to better positioning accuracy in dynamic situations since between the time of transmission and the time of reception, the position of the transmitter position may have changed. A discrepancy between the system's representation of the audio source position and the actual position of the audio source (as may be visualized by the user) reduces the ability of the user to "believe" or to accurately perceive the spatial audio effect being generated. Both positioning accuracy and relative velocity are important to emulate natural human hearing.

The head orientation measurement unit provides continuous tracking of the user's head position. Knowing the user's head position is critical to providing the audio information in the correct position in 3D space relative to the user's head, since the perceived location of the audio information is head position dependent and the user's head can swivel rapidly. The head orientation measurement unit may include a dedicated inertial measurement unit (IMU) or magnetic compass (magnetometer) sensor, such as the Bosch BM1160X. Alternatively, the head position can be measured and extracted through a head mounted detection system located on the head of the user.

The communication unit may include one or more communication channels for conveying information between internal subsystems or to/from external users. The communication channel may use any type of channel model (digital or analog) and any suitable transmission protocol (e.g., Wi-Fi, Wi-Fi Direct, Bluetooth, GSM, GMRS, FRS, FM, and the like). The communication channel maybe used as the medium to communicate the GPS coordinates of each individual in the group and/or relay the audio information to and from the members of the group and the user. The transmitted information may include but not limited to: audio, video, relative and/or global user location data, user identification, and other forms of information. The communication unit may employ more than one communications channel to allow for coverage of a larger area for group activity while maintaining low latency and good performance for users in close proximity to each other. For example, the communication unit may be configured to use Wi-Fi for users up to 100 m apart, and use the cellular network for communications at distances greater than 100 m. Functionally this configuration may work well since the added latency of the cellular network is less important at greater distances. In one embodiment, the communication unit may be installed as part of a software application running on a mobile device (e.g., a cellular phone, or a tablet computer). In an alternative embodiment, the communication unit may be part of a spatial communications system, which may contain dedicated inter-device communications components configured to operate under a suitable transmission protocol (e.g., Wi-Fi, Wi-Fi Direct, Bluetooth, GSM, GMRS, FRS, FM, sub-Giga, and the like). An example of a dedicated component that could allow for both short-range and long-range communication is the Texas Instruments CC1352P chip that can be configured in numerous configurations for group communications using different communication stacks (e.g., smart objects, M-Bus, Thread, Zigbee, KNX-RF, Wi-SUN, and the like). These communication stacks include mesh network architectures that may improve communication reliability and range. In another embodiment, the detection unit can be configured to transmit information between users in the group, such as via a technique known as "radar communication" or "RadCom" as known in the art (as described for example in: Hassanein et al. A Dual Function Radar-Communications system using sidelobe control and waveform diversity, IEEE National Radar Conference—Proceedings 2015:1260-1263). This embodiment would obviate the need to correlate the ID of the user with their position to generate their spatial audio representation since the user's audio information will already be spatialized and detected coming from the direction that their RadCom signal is acquired from. This may substantially simplify the implementation since there is no need for additional hardware to provide localization of the audio source or to transmit the audio information, beyond the existing detection unit.

Similar functionality described for RadCom can also be applied to ultrasound-based detection units (Jiang et al, Indoor wireless communication using airborne ultrasound and OFDM methods, 2016 IEEE International Ultrasonic Symposium). As such this embodiment can be achieved with a detection unit, power unit and audio unit only, obviating but not necessarily excluding, the need for the head orientation measurement, positioning, and communication units.

The processing unit receives the positioning data of the surrounding users from the detection unit and the communication unit. The processing unit tracks the users in the surrounding area using suitable tracking techniques, such as based on Extended Kalman filters, scented Kalman filters, and the like. The processing unit correlates between the tracks of the detection unit and the positions of other users received by the communication unit. If the correlation is high, the detection track is assigned the ID and continuously verifies that the high correlation is maintained over time. The processing unit acquires the other users' information from the communications unit. In the case a user ID is included in the data, the data is now attached to the track with the corresponding user ID. In the case the data contains audio information, the processing unit uses the spatial information of the corresponding user and the head orientation information of an ego-user and uses head-related transfer function (HRTF) algorithms to generate the spatially representative audio stream to be transmitted to the audio interface. This may be done for a multitude of users simultaneously to generate a single spatially representative audio stream containing all the users' audio representations. The relative velocity can also be acquired by the detection unit and/or the positioning unit and/or other user's velocity and heading from the communication unit. The relative velocity between the ego-user and the other users can be used to impart a Doppler shift onto the generated audio stream. Doppler shifted audio may provide intuitive information to the ego-user regarding the relative velocity of the surrounding users. The processing unit could be either a dedicated unit located on the platform or a software application running on an off-board, general processing platform (such as a smartphone or tablet computer). In an embodiment of the present invention the processing unit provides real-time, mission critical computational resources and/or can incorporates other audio and/or data input elements such as a GPS or telephone. The processing unit is optionally connected to the helmet-mounted audio interface unit by either a cable or wireless protocol that can ensure real-time, mission critical data transfer. The processing unit is responsible for managing the user IDs currently in the vicinity of the user and cross-referencing those user IDs with the ego-user's defined group preferences and/or other information available on an on-line database regarding the user IDs. The processing unit is also responsible for the process of inclusion and exclusion into the ego-user's group and the connection protocol with other users.

The audio unit is required to convey the spatially resolved audio information to the user. The audio unit thus includes at least two transducers (one for each ear) and can use different methods of conducting the audio information to the respective ear. Such methods include, but are not limited to: multichannel systems, stereo headphones, bone conduction headphones, and crosstalk cancellation speakers. The audio transmissions can be overlaid on top of ambient sound that has been filtered through the system using microphones together with known analog and/or signal processing. A separate microphone may also be included for the user's voice transmission. The system can be implemented with ambient audio directly to the audio stream or alternatively by feeding the ambient audio through adaptive/active noise cancellation filtering (implemented in software or in hardware) prior to providing the user with the audio display. The audio transmissions can also be overlaid on top of other audio information being transmitted to the user such as: music, synthesized spatial audio representations of surrounding objects, phone calls, and the like.

Figure 3:
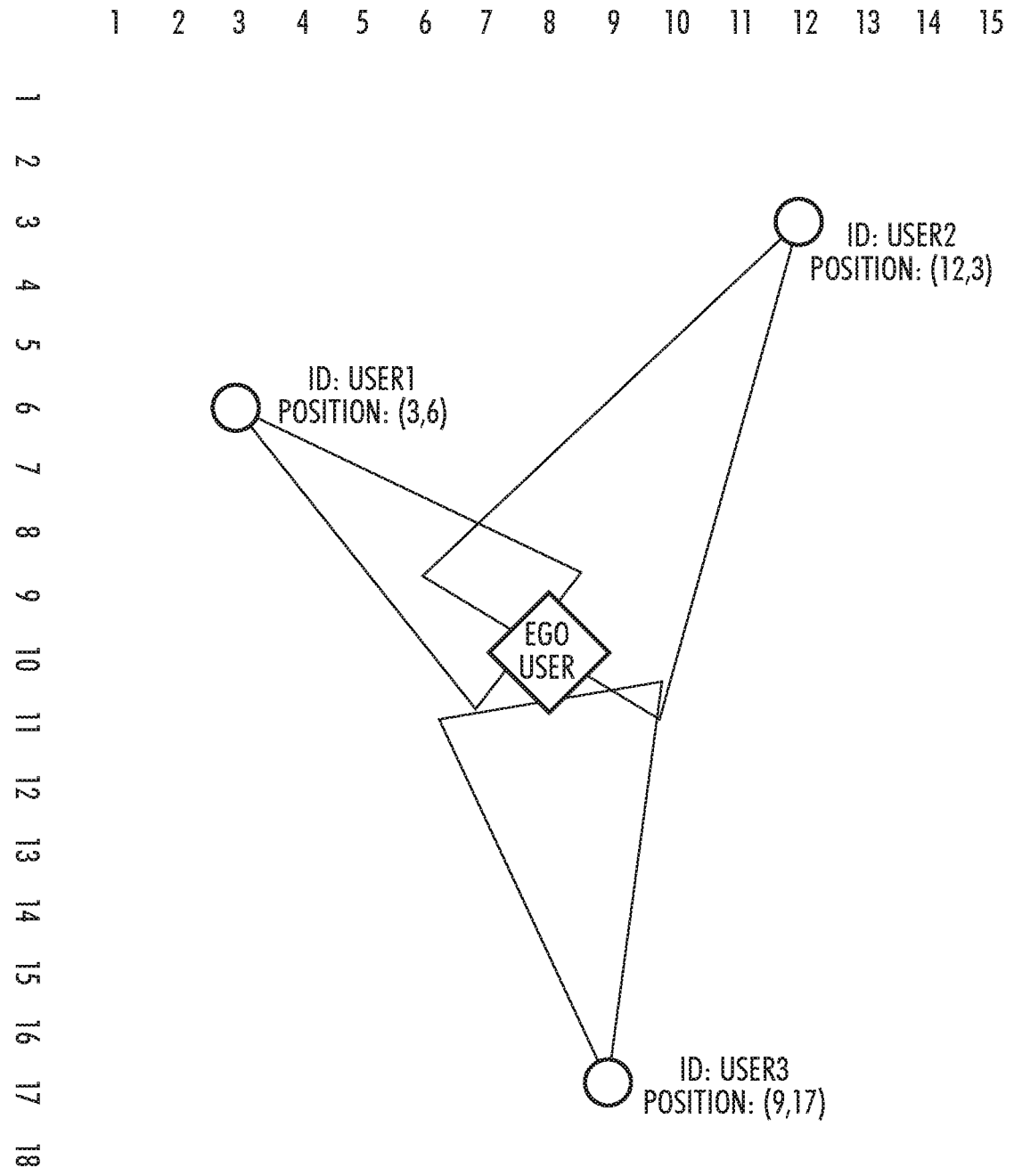
FIG. 3 is an illustration of an exemplary projection of information from multiple surrounding users to an individual ego-user, operative in accordance with an embodiment of the present invention.

Reference is made to FIG. 3, which is an illustration of an exemplary projection of information from multiple surrounding users to an individual ego-user, operative in accordance with an embodiment of the present invention. The users may choose to send meta-data including the ID of the user and/or position in addition to any audio or other data for transmission.

Figure 4:
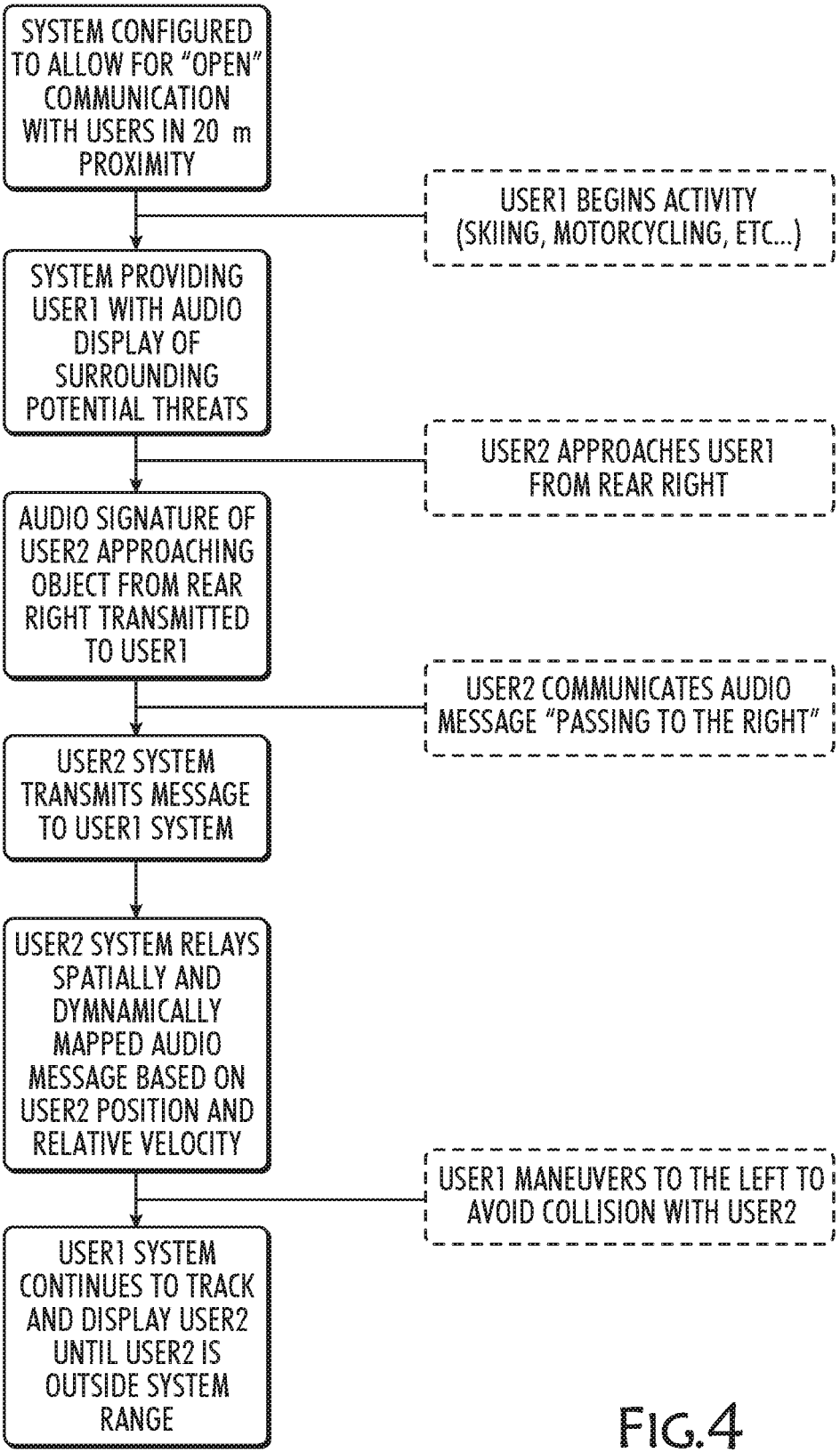
FIG. 4 is a flow diagram of a RadCom mode operation of the system for spatially projected audio communication, operative in accordance with an embodiment of the present invention.

Reference is made to FIG. 4, which is a flow diagram of a RadCom mode operation of the system for spatially projected audio communication, operative in accordance with an embodiment of the present invention. No handshaking or group definitions are required to initiate and maintain spatially mapped communication except for a definition of the allowed range for communication.

Figure 5:
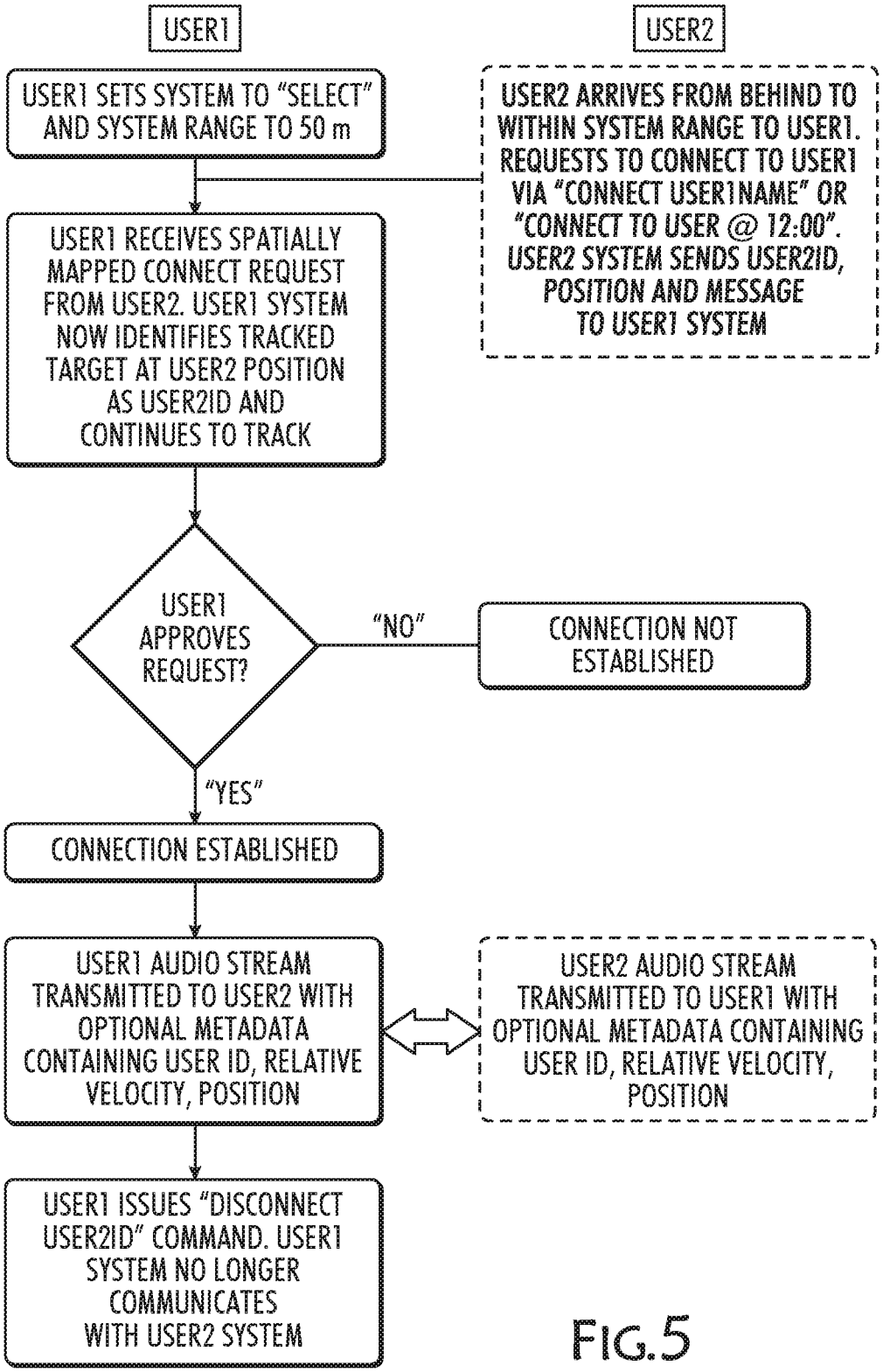
FIG. 5 is a flow diagram of audio intercommunication between selected users of a group, operative in accordance with an embodiment of the present invention.

Reference is made to FIG. 5, which is a flow diagram of audio intercommunication between selected users of a group, operative in accordance with an embodiment of the present invention. The users can be predefined or they can be added dynamically as described in this flow diagram.

Figure 6:
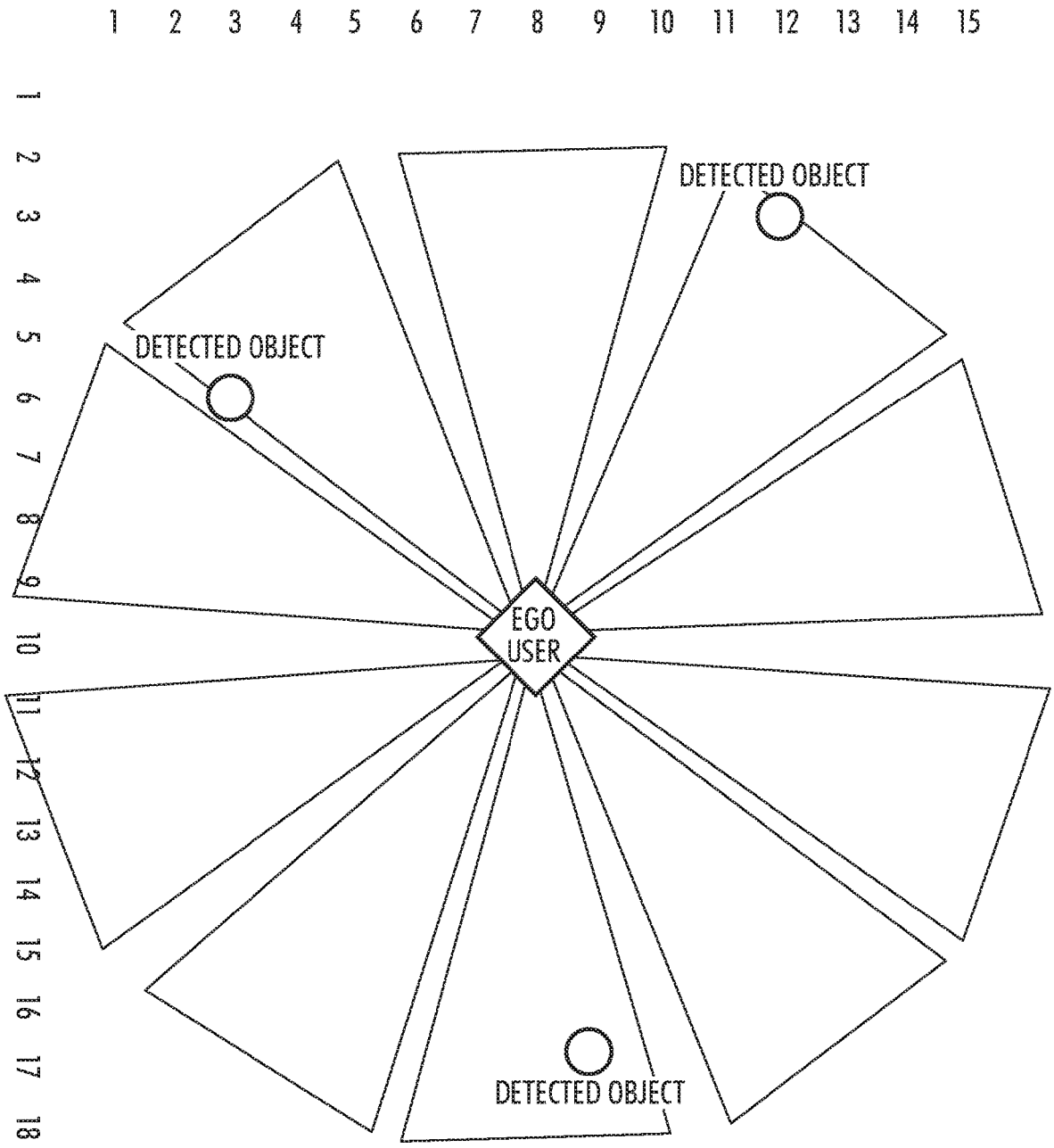
FIG. 6 is an illustration of the detection of surrounding objects by the system for spatially projected audio communication of an ego-user, operative in accordance with an embodiment of the present invention.

Reference is made to FIG. 6, which is an illustration of the detection of surrounding objects by the system for spatially projected audio communication of an ego-user, operative in accordance with an embodiment of the present invention. In this embodiment, the objects are not identified until ID and position information is acquired through the communication unit.

Figure 7:
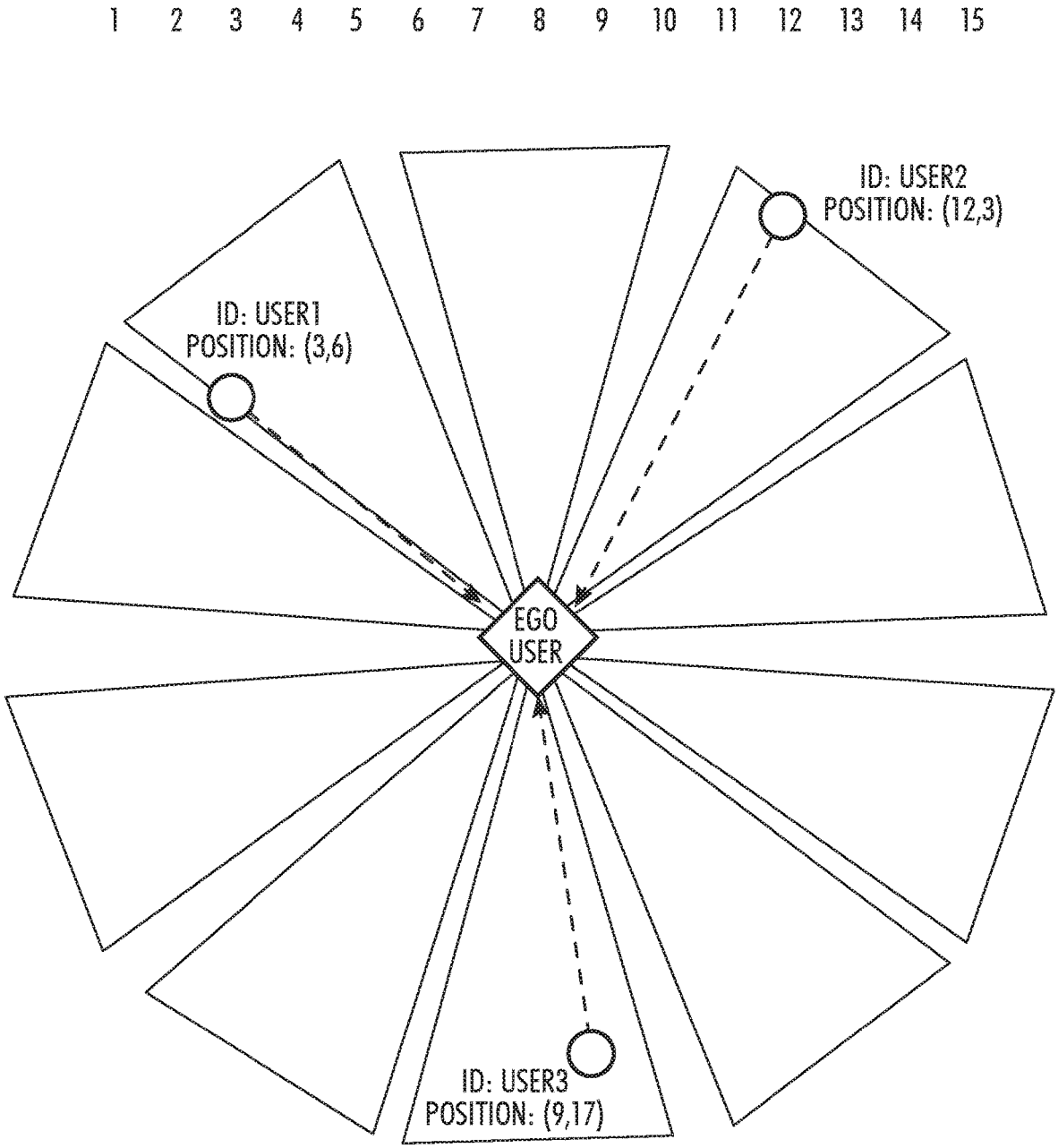
FIG. 7 is an illustration of the detection of identification and location data by the communication unit of the system for spatially projected audio communication, operative in accordance with an embodiment of the present invention.

Reference is made to FIG. 7, which is an illustration of the detection of identification and location data by the communication unit of the system for spatially projected audio communication, operative in accordance with an embodiment of the present invention. The identification and location data is either directly transmitted from the users via a short range communication protocol (e.g., Wi-Fi, Wi-Fi Direct, Bluetooth) or from a centralized database accessed via the Internet.

Figure 8:
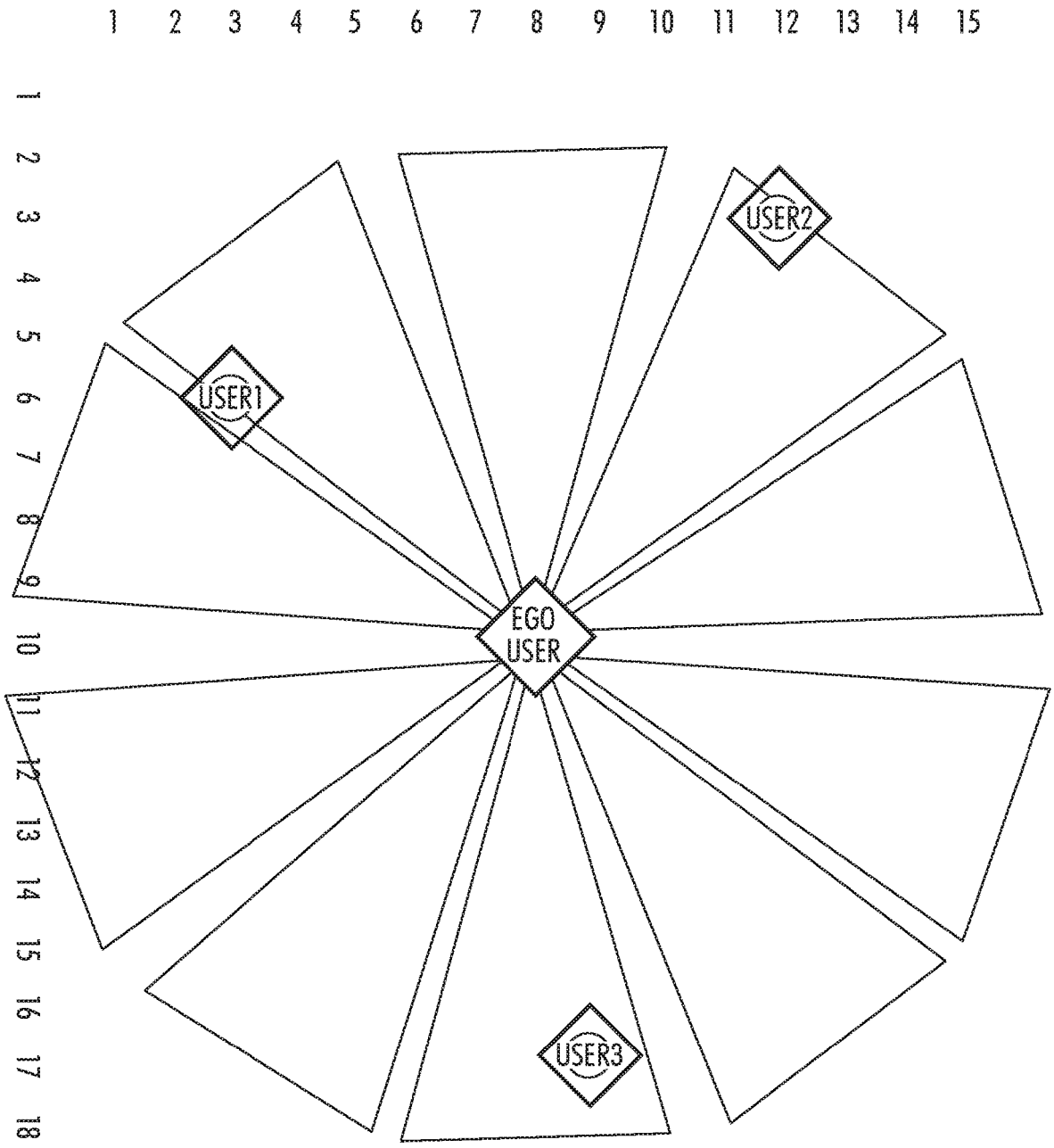
FIG. 8 is an illustration of the association of detected objects with the user position by the system for spatially projected audio communication of an ego-user, operative in accordance with an embodiment of the present invention.

Reference is made to FIG. 8, which is an illustration of the association of detected objects with the user position by the system for spatially projected audio communication of an ego-user, operative in accordance with an embodiment of the present invention. The system now tracks the users while they are in range. The users may continue to update their position via the communication unit in parallel to being tracked.

Figure 9:
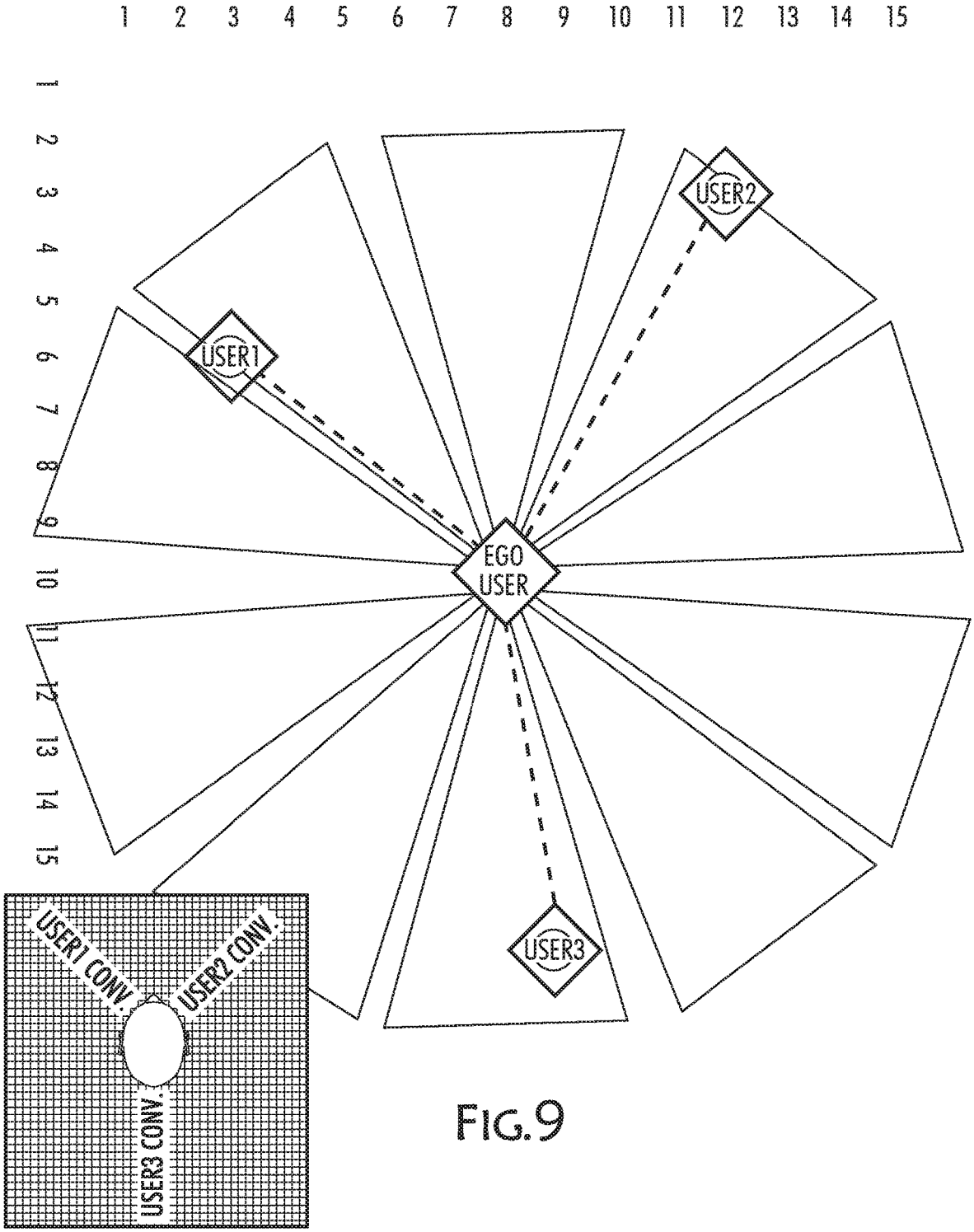
FIG. 9 is an illustration of the spatial projection of audio by the system for spatially projected audio communication of an ego-user, operative in accordance with an embodiment of the present invention.

Reference is made to FIG. 9, which is an illustration of the spatial projection of audio by the system for spatially projected audio communication of an ego-user, operative in accordance with an embodiment of the present invention. After receiving the user position and ID information, the ego-user system has the spatial and identification information to spatially project the audio conversations.

Figure 10:
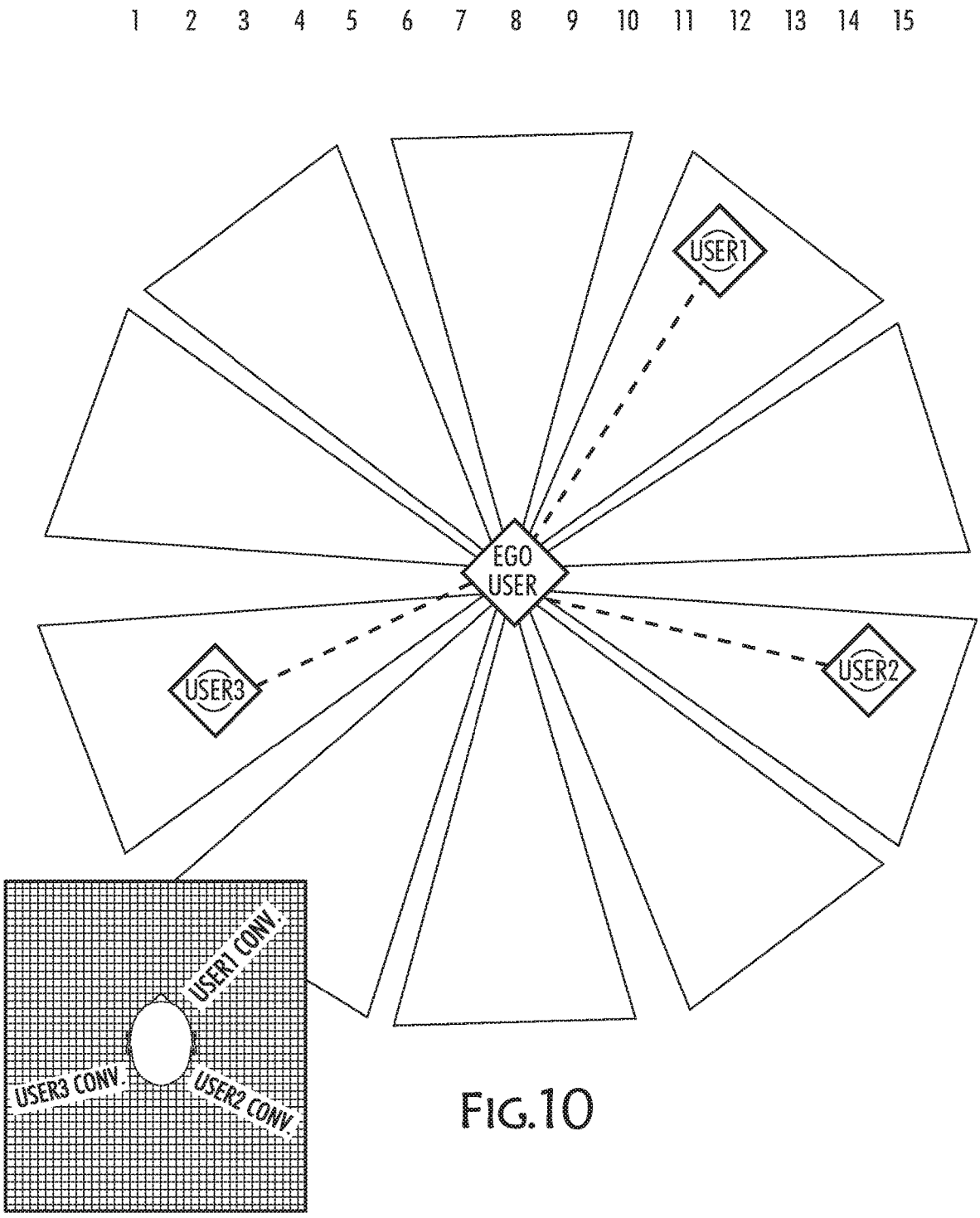
FIG. 10 is an illustration of the tracking of user positions by the system for spatially projected audio communication of an ego-user, operative in accordance with an embodiment of the present invention.

Reference is made to FIG. 10, which is an illustration of the tracking of user positions by the system for spatially projected audio communication of an ego-user, operative in accordance with an embodiment of the present invention. The ego-user system continuously tracks the position of the users and updates the audio display according to the new positions of the users.

Figure 11:
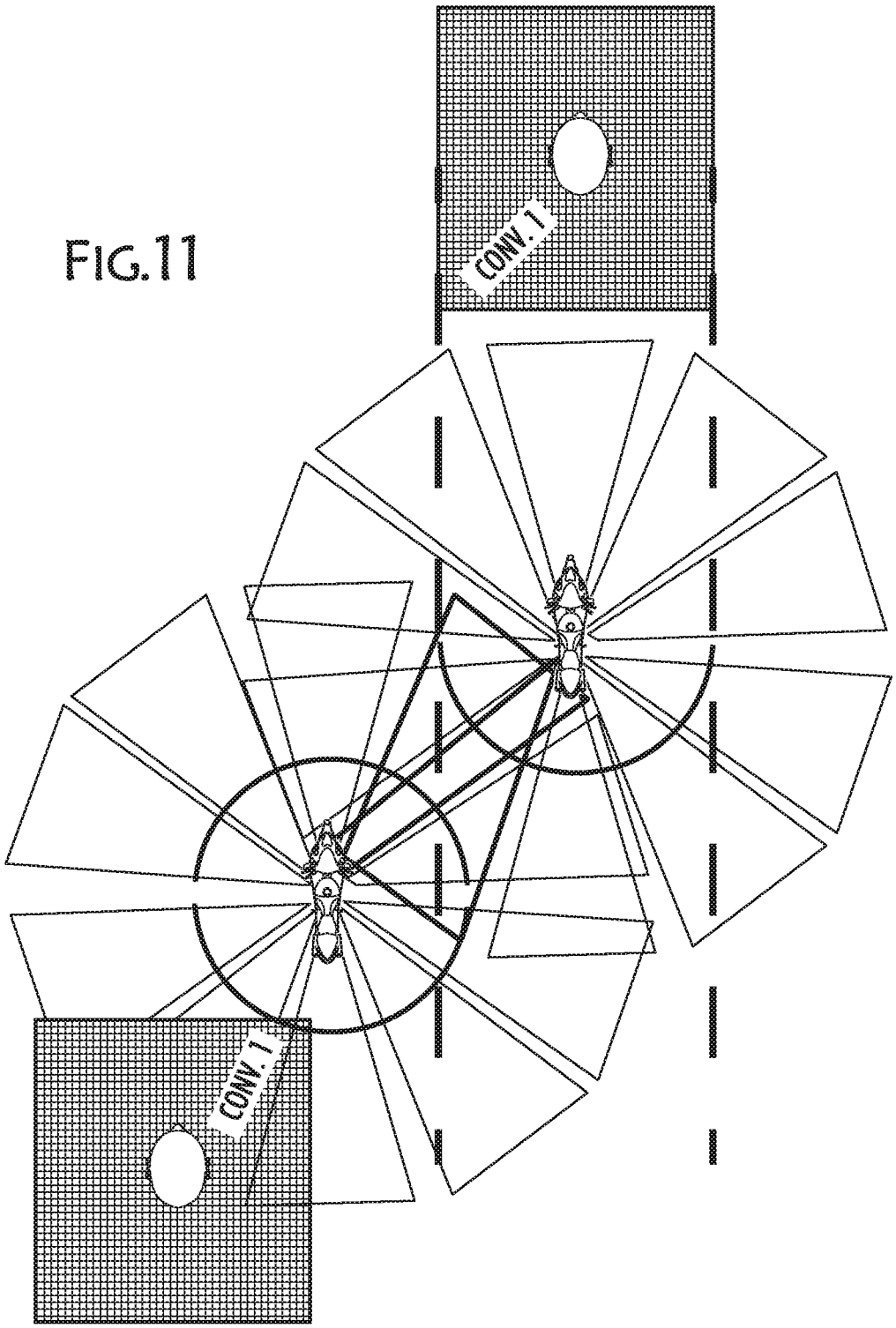
FIG. 11 is an illustration of an exemplary operation of systems for spatially projected audio communication of respective motorcycle riders, operative in accordance with an embodiment of the present invention.

According to an embodiment of the present invention, the system is installed on the helmets of respective motorcycle riders traveling in a group. Reference is made to FIG. 11, which is an illustration of an exemplary operation of systems for spatially projected audio communication of respective motorcycle riders, operative in accordance with an embodiment of the present invention. Each rider in the group has a system installed and operational. The detection unit may include a plurality (e.g., three) radar modules that are mounted on the helmet of each user in such a manner as to provide 360 degree coverage. The detection unit may inherently provide the low latency head tracked spatial data that is necessary to create the effect of externalization and localization for spatially projecting the synthesized sound being produced by the communication unit. The detection unit provides detections of objects surrounding an ego-user with low latency. Spatially accurate head tracked data is especially important in demanding high-performance applications such as motorcycle riding due to the high absolute and relative speed of the riders. The system of the ego-user detects the relative position of other riders in the vicinity.

The system acquires the ID and GPS coordinates of the users within the detection range of the system and correlates the GPS position to that provided by the detection unit. Once a successful correlation is found, the detection track of the user as identified by the detection unit now has a corresponding unique ID to associate the data being transmitted from that ID through the communication unit. The system can now project the audio information of the user with a particular ID from the point in space of the detected track. This process is done on each rider's system to allow for spatial representation of each and all users in the group that are within the detection range of the system.

The detection unit also provides information on additional objects (other than the other users) near the first user and the spatial audio display generated by the processing unit in conjunction with the detection system and microphones can be synthesized with the spatial communications data being provided to the user (as described for example in U.S. patent application Ser. No. 15/531,563 to Tammam et al). The communication unit can also interface and simultaneously display audio data from other sources, such as cellular telephones, computers, or other wireless communication devices. Alternatively, RadCom may be implemented on the detection unit located on the riders' helmets, thereby providing a communication unit as part of the detection unit with the advantages discussed hereinabove.

Figure 12:
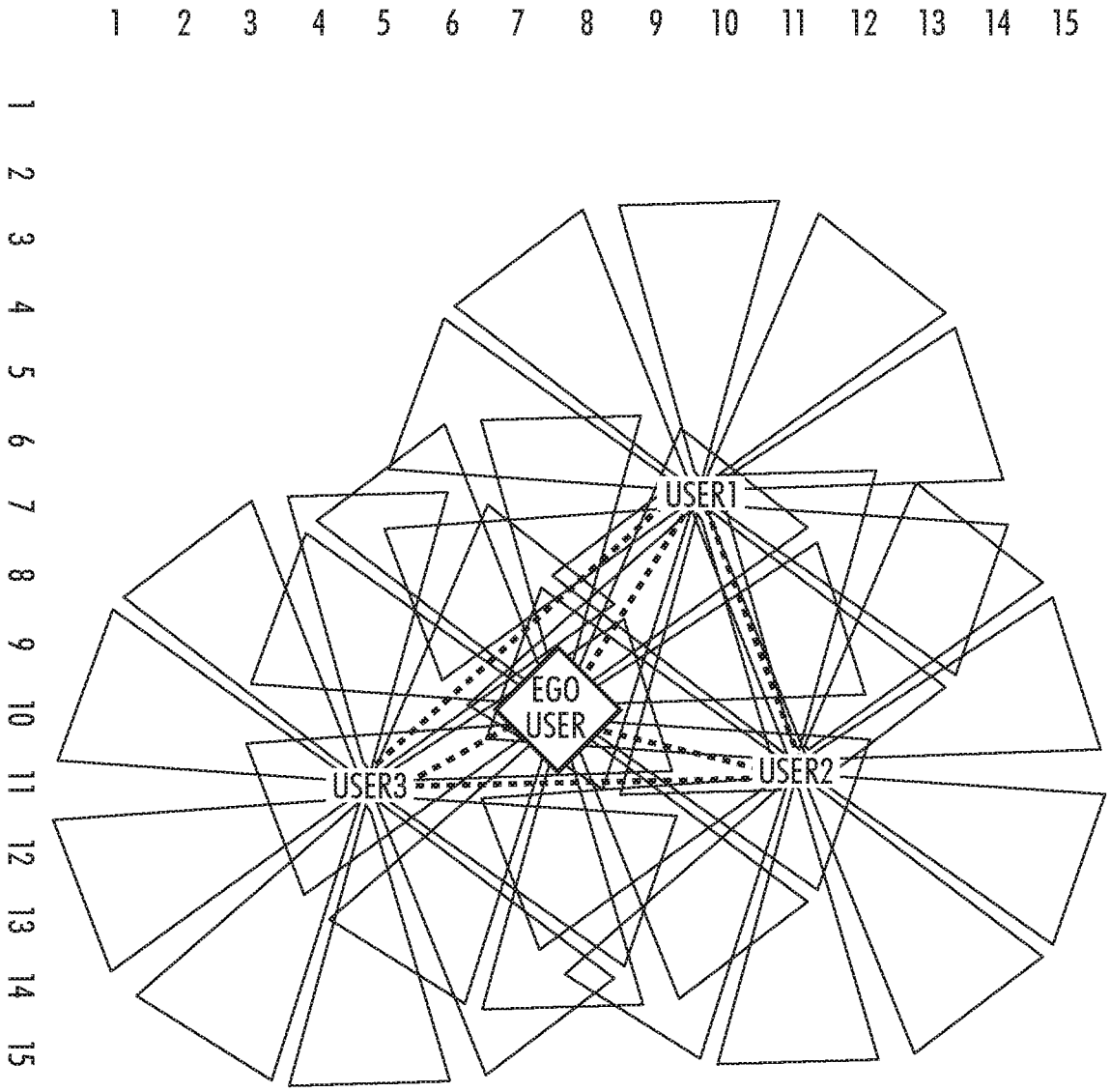
FIG. 12 is an illustration of the overlapping fields of view of the detection units and interconnecting communication channels among users in a group, operative in accordance with an embodiment of the present invention.

Reference is made to FIG. 12, which is an illustration of the overlapping fields of view of the detection subsystems and interconnecting communication channels among users in a group, operative in accordance with an embodiment of the present invention. FIG. 12 demonstrates the ability to use a mesh framework to allow for extended range and/or redundancy.

Figure 13:
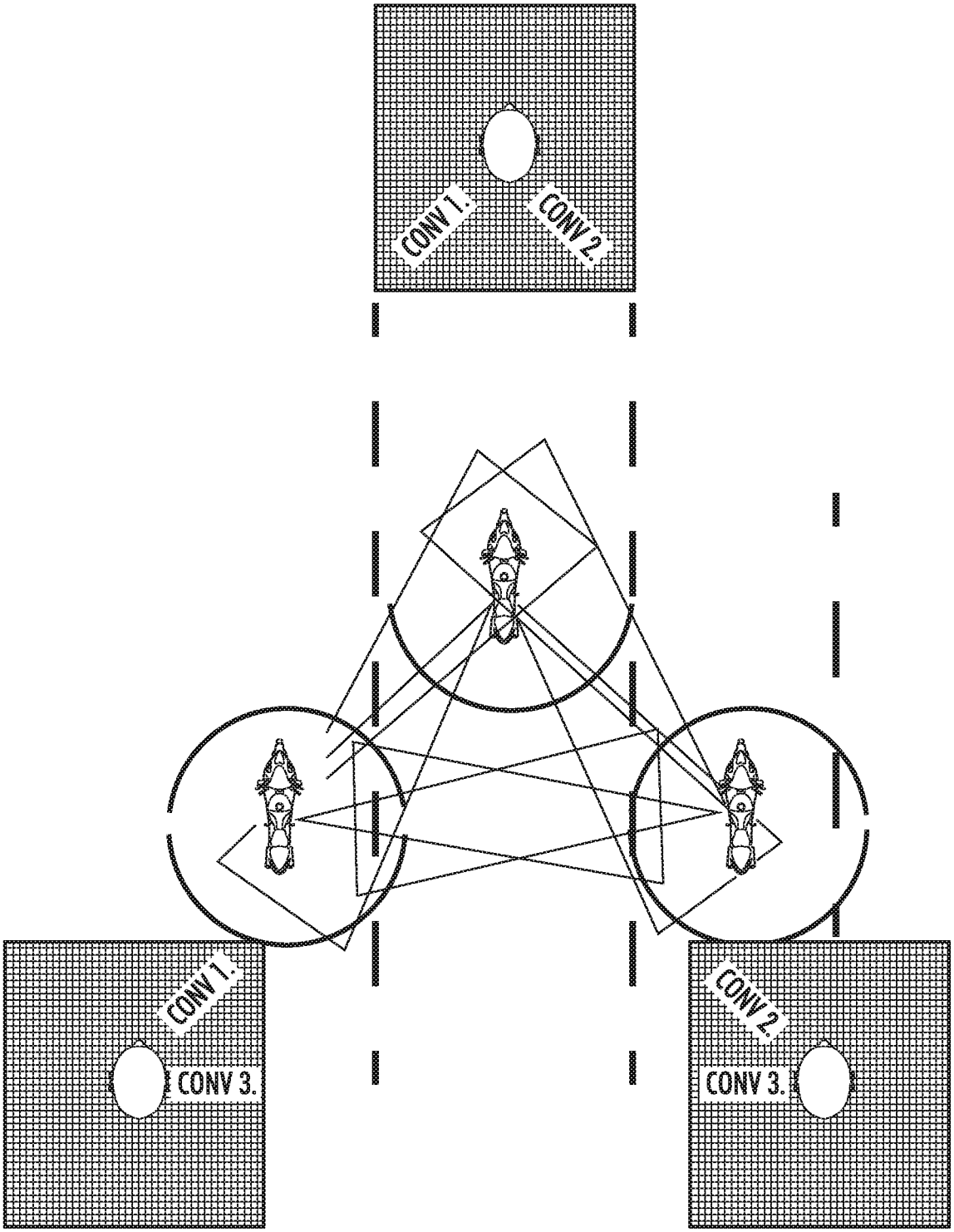
FIG. 13 is an illustration of a three-way conversation between motorcyclists in a group by the respective systems for spatially projected audio communication, operative in accordance with an embodiment of the present invention.

Reference is made to FIG. 13, which is an illustration of a three-way conversation between motorcyclists in a group by the respective systems for spatially projected audio communication, operative in accordance with an embodiment of the present invention. FIG. 13 illustrates a three-way conversation held between motorcyclists in a group and the perceived direction the conversation is being heard from.

According to another embodiment of the present invention, the system may be applied to users in a group engaged in an activity, such as skiing, in which the application is cost sensitive and has lower performance requirements. The system in such an embodiment may include: a head orientation measurement unit, a positioning unit, a communication unit, a processing unit, a power unit and an audio interface unit, but does not necessarily contain a detection unit. The audio compression and decompression may (but not necessarily) be performed on a codec separate from the processing unit. The processing unit may be a dedicated unit or a software application running on a mobile device (e.g., smartphone, tablet or laptop computer). In this embodiment, the GPS position of the users in the group combined with the head tracking motion sensors can provide for a less accurate and higher latency system but sufficient to maintain the spatial audio effect in applications where the absolute and relative motion between users is relatively slow and spatial accuracy is less critical. High accuracy GPS units such as GNSS Precise Point Positioning (PPP), GNSS in conjunction with inertial navigation systems (INS), continuously operated reference station (CORS) corrected GPS or other positioning techniques that can provide for positioning accuracy within 10 meters. Each message conveyed to the group must contain the position information together with the other transmitted data but the ID of the user is optional in this embodiment. The ID may optionally be used to allow for an exclusive group of selected participants rather than open communications allowing for communications with any users within a certain range. The system may also allow for a combination of open communications and exclusive communications such as allowing open communications with any user up to a predefined range and exclusive communications with certain users up to a larger range. Such a system configuration would allow for spatial communication with users in close proximity to relay critical safety information while also allowing for spatial communication with preselected users irrespective of their relative distance.

For indoor applications, other positioning techniques maybe employed such as indoor positioning system (IPS) that have been developed for indoor navigation in the absence of a robust GPS signal. Such applications may include football players or groups of people spatially dispersed amongst other groups of people that would like to have a conversation.

The output of the system can be recorded and integrated into or interface with video devices that are either head mounted, vehicle mounted, stationary or otherwise, to provide a spatially mapped audio track to a video stream. This may be particularly beneficial in 3D video applications that would provide observers of the video with an immersive spatial audio experience. In such applications, each user with a spatially projected audio communication system during video streaming and/or recording can have their audio channel spatially mapped and integrated onto the video. The integration of the spatially mapped audio source can be done either off-line through video editing software or on-line. The on-line integration can be done through software, either on a mobile device or on the video camera itself.

In another embodiment, the system can be installed on vehicles or users of vehicles allowing for communication of operators of the vehicles with spatially mapped audio information being transmitted to the vehicle operators. In another embodiment, the system can be installed on remotely operated vehicles and transmit the communications between operators in a spatially mapped manner that relates to the position of the remotely operated vehicles. Such a system would allow for more efficient coordination between drone operators in formation or coordinating maneuvers.

In an additional embodiment, the system components can be implemented into a monolithic integrated circuit or System on Chip (SoC) design. The integrated functionalities may include but not limited to, the SLAM sensor radio frequency interface, high accuracy GNSS/GPS sensor, a communication channel, a magnetic compass, an inertial measurement unit (IMU), a processing unit and an audio driver. Such a design may provide the benefits of reducing per unit cost, lower latency, small form factor and lower power consumption.

An alternative embodiment may use SLAM sensors to register the relative position of one user with respect to other users using landmarks in the vicinity of the group. The distance of the user from the landmarks can be used to triangulate the location of the user with respect to the other users in the vicinity of that user, thereby obviating the need for absolute coordinates from a GPS system. This configuration can be useful in indoor applications where GPS signals cannot penetrate the structure the user is located within.

In another embodiment, the communication between users is implemented through a cellular phone with a specific software application used to log and track the users in the group. The users join a group through the application and the system begins transmitting the positioning and audio data from the user to the group.

Additional applications for the system and method of the present invention include spatial communications for bicycle riders, skiers, snowboarders, surfers, infantry, drone operators or other groups of intercommunicating individuals where spatially locating the participants may be of importance.

The system of the present invention may provide an audio display including audio spatial information to a first user, and detect an audio signature of an approaching threat and update the audio interface unit of the first user with approaching threat information, including spatial information. The system may track the approaching threat and continuously update the audio interface unit until the approaching threat is out of range. The approaching threat may be a second user, which may transmit an informational message, including spatial information, to the first user such that the first user's system updates the audio interface unit to include the second user based on the informational message. The informational message may include at least one of: position, relative velocity, direction of travel, relative orientation to the first user, and acceleration.

The terms "comprises", "comprising", "includes", "including", "having" and their conjugates mean "including but not limited to". The term "consisting of" means "including and limited to". The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

While certain embodiments of the disclosed subject matter have been described, so as to enable one of skill in the art to practice the present invention, the preceding description is intended to be exemplary only. It should not be used to limit the scope of the disclosed subject matter, which should be determined by reference to the following claims.

The invention claimed is:

1. A system for providing spatially projected audio communication between members of a group of a plurality of users, the system associated with a respective ego-user of the group, the system comprising:

a positioning unit, configured to determine a user position of the ego-user;

a head orientation measurement unit, configured to determine a head position and orientation of the ego-user;

a communication unit, configured to transmit at least a determined user position of the ego-user, a user identifier of the ego-user, and audio information of the ego-user, to at least one other system associated with at least one other user of the group, the communication unit further configured to receive at least a user position of at least one other user of the group, a user identifier of the other user, and audio information of the other user, from at least one other system associated with the other user;

a processing unit, configured to track the user position of at least one other user of the group and to establish a relative position of the other user relative to the ego-user, based on the received user position and the received user identifier of the other user, and to synthesize a spatially resolved audio signal of the received audio information of the other user, based on the established relative position of the other user and based on the determined head position and orientation of the ego-user; and an audio interface unit, configured to audibly convey the synthesized spatially resolved audio signal to the ego-user.

2. The system of claim 1, wherein at least one of the system units is mounted on the head of the ego-user.

3. The system of claim 1, further comprising a detection unit, comprising a plurality of sensors, the detection unit configured to detect a dynamic user position of at least one other user of the group, wherein the processing unit is configured to track the user position of the other user, by correlating the detected user position of the other user obtained from the detection unit with the received user position of the other user received by the communication unit.

4. The system of claim 3, wherein the detection unit is further configured to detect a relative velocity between the ego-user and at least one other user of the group, and wherein the processing unit is configured to impart a Doppler shift onto the synthesized spatially resolved audio signal, based on the detected relative velocity.

5. The system of claim 3, wherein the detection unit comprises a plurality of simultaneous localization and mapping (SLAM) sensors, arranged in a configuration to provide substantially 360° coverage around the ego-user.

6. The system of claim 3, wherein the detection unit is integrated with the communication unit and configured to transmit and receive information via a radar-communication (RadCom) technique.

7. A method for providing spatially projected audio communication between members of a group of a plurality of users, the method comprising the procedures of:

determining a user position of an ego-user of the group, using a positioning unit associated with the ego-user;

determining a head position and orientation of the ego-user, using a head orientation measurement unit associated with the ego-user;

transmitting at least a determined user position of the ego-user, a user identifier of the ego-user, and audio information of the ego-user, to at least one other system associated with at least one other user of the group;

receiving at least a user position of at least one other user of the group, a user identifier of the other user, and audio information of the other user, from at least one other system associated with the other user;

tracking the user position of at least one other user of the group and establishing a relative position of the other user relative to the ego-user, based on the received user position and the received user identifier of the other user;

synthesizing a spatially resolved audio signal of the received audio information of the other user, based on the established relative position of the other user and based on the determined head position and orientation of the ego-user; and audibly conveying the synthesized spatially resolved audio signal to the ego-user via an audio interface unit.

8. The method of claim 7, wherein at least one of the system units is mounted on the head of the ego-user.

9. The method of claim 7, further comprising the procedures of:

detecting a dynamic user position of at least one other user of the group, with a detection unit comprising a plurality of sensors; and tracking the user position of the other user, by correlating the detected user position of the other user obtained from the detection unit with the received user position of the other user received by the communication unit.

10. The method of claim 9, further comprising the procedures of:

detecting a relative velocity between the ego-user and at least one other user of the group, with the detection unit; and imparting a Doppler shift onto the synthesized spatially resolved audio signal, based on the detected relative velocity.

* * * * *